US010231533B2

(12) United States Patent
Vaughan et al.

(10) Patent No.: US 10,231,533 B2
(45) Date of Patent: Mar. 19, 2019

(54) WEARABLE PACK

(71) Applicants: Robert Vaughan, Aiken, SC (US); Dennis O'Connor, Severna, MD (US); Brian Naillon, Augusta, SC (US); Von Bolin, Eutawville, SC (US); Wallace Lau, Lewis Center, OH (US)

(72) Inventors: Robert Vaughan, Aiken, SC (US); Dennis O'Connor, Severna, MD (US); Brian Naillon, Augusta, SC (US); Von Bolin, Eutawville, SC (US); Wallace Lau, Lewis Center, OH (US)

( * ) Notice: Subject to any disclaimer, the term of this patent is extended or adjusted under 35 U.S.C. 154(b) by 1 day.

(21) Appl. No.: 15/584,067

(22) Filed: May 2, 2017

(65) Prior Publication Data

US 2017/0318941 A1 Nov. 9, 2017

Related U.S. Application Data

(60) Provisional application No. 62/331,157, filed on May 3, 2016.

(51) Int. Cl.

| | |
|---|---|
| ***A45F 3/06*** | (2006.01) |
| ***F41H 1/00*** | (2006.01) |
| ***F41H 5/00*** | (2006.01) |
| ***A45F 4/02*** | (2006.01) |
| ***A41D 1/04*** | (2006.01) |
| ***F41H 1/02*** | (2006.01) |

(52) U.S. Cl.

CPC ..... *A45F 3/06* (2013.01); *A41D 1/04* (2013.01); *F41H 1/02* (2013.01); *A45F 4/02* (2013.01); *F41H 1/00* (2013.01); *F41H 5/00* (2013.01)

(58) Field of Classification Search

CPC ..... A45F 3/04; A45F 3/06; A45F 4/02; F41H 1/00; F41H 5/00

USPC ..... 224/153, 581

See application file for complete search history.

(56) References Cited

U.S. PATENT DOCUMENTS

| | | | | | |
|---|---|---|---|---|---|
| 4,830,245 | A | * | 5/1989 | Arakaki | A45F 3/04 2/2.5 |
| 5,031,733 | A | * | 7/1991 | Chang | A41D 15/04 190/1 |
| 5,337,934 | A | * | 8/1994 | Johnson | A41D 13/0012 224/148.5 |
| 5,657,917 | A | * | 8/1997 | Johnson | A45F 3/04 224/153 |
| 5,673,836 | A | | 10/1997 | Bush | |
| 5,676,293 | A | * | 10/1997 | Farris | A45F 3/04 2/175.7 |
| 5,724,707 | A | | 3/1998 | Kirk et al. | |

(Continued)

FOREIGN PATENT DOCUMENTS

WO WO2016062745 4/2016

OTHER PUBLICATIONS

PCT International Search Report and Written Opinion, dated Jul. 19, 2017.

*Primary Examiner* — Justin Larson

(74) *Attorney, Agent, or Firm* — B. Craig Killough; Barnwell Whaley Pattereson & Helms

(57) ABSTRACT

A wearable container or pack that is quickly convertible into front and rear body armor without removing the pack from the torso of the wearer. The container or pack may include a bag that may be easily separated from the container or pack, and quickly dropped from the container or pack, providing supplies for another person.

15 Claims, 11 Drawing Sheets

(56) References Cited

U.S. PATENT DOCUMENTS 5,909,802 A 6/1999 Puco et al.
5,946,729 A * 9/1999 Sakurai ..... A42B 1/08 2/202
5,991,925 A 11/1999 Wu
6,010,051 A * 1/2000 Callanan ..... A45F 3/04 224/237
6,161,738 A 12/2000 Norris
6,419,132 B1 * 7/2002 Reed ..... A45C 15/00 109/49.5
6,685,071 B2 2/2004 Prather
7,036,420 B1 * 5/2006 Kummerer ..... A45F 3/06 190/109
7,316,340 B2 * 1/2008 Marik ..... A45F 3/04 224/631
D569,043 S * 5/2008 Crye ..... D29/100
7,441,278 B2 10/2008 Blakeley
8,070,030 B2 * 12/2011 Marik ..... A45F 3/04 224/579
8,387,843 B2 * 3/2013 Kramer ..... A45F 3/08 224/581
8,887,976 B2 * 11/2014 Vierthaler ..... A45F 3/08 224/631
8,997,262 B2 4/2015 Klein
9,022,269 B1 5/2015 Woodcock
9,044,074 B1 6/2015 De Freitas et al.
9,820,558 B1 * 11/2017 de Geus ..... A45F 4/02
9,949,557 B2 * 4/2018 Crimaldi ..... A45F 3/10
2007/0266469 A1 * 11/2007 Blakeley ..... F41C 33/06 2/2.5
2007/0295772 A1 12/2007 Woodmansee
2009/0014490 A1 * 1/2009 Bradley ..... A45C 13/008 224/576
2010/0230458 A1 * 9/2010 Kramer ..... A45F 3/08 224/581
2011/0097021 A1 4/2011 Curran et al.
2011/0231976 A1 * 9/2011 Herbener ..... A41F 1/008 2/2.5
2012/0132066 A1 5/2012 Seuk
2012/0174286 A1 7/2012 McBride et al.
2014/0101810 A1 4/2014 Tirard
2015/0082524 A1 * 3/2015 Ben David ..... F41H 1/02 2/463
2015/0196077 A1 * 7/2015 McIntire, Jr. ..... A41D 15/04 2/2.5
2016/0022016 A1 * 1/2016 Wolffe ..... A45F 3/04 224/581
2016/0360864 A1 12/2016 Drake
2017/0102214 A1 * 4/2017 Wright ..... F41H 1/02
2018/0003466 A1 * 1/2018 Rose ..... F41H 1/02

* cited by examiner

WEARABLE PACK

Applicant claims the benefit of Provisional Application Ser. No. 62/331,157 filed May 3, 2016.

FIELD OF THE INVENTION

The present invention relates to wearable containers or packs, and is more particularly related to a wearable container or back pack that is convertible into body armor.

BACKGROUND OF THE INVENTION

Law enforcement and military are deployed into hostile situations in which they have a need to carry supplies and equipment. Supplies may be used for tactical use by law enforcement or military personnel, or the contents of the pact may include medical supplies or other articles that are useful to personnel who are injured or wounded.

It is desirable that law enforcement or military have body armor available to them. At the same time, the combination of body armor and a container or pack for supplies and equipment should not be bulky or interfere with movement, either due to weight of the pack or the construct of the pack.

SUMMARY OF THE INVENTION

The present invention is a wearable container or pack that is quickly convertible into front and rear body armor without removing the pack from the torso of the wearer. The container or pack includes a bag that may be easily separated from the container or pack, and quickly dropped from the container or pack, providing supplies for another person.

BRIEF DRAWING DESCRIPTION

DESCRIPTION OF PREFERRED EMBODIMENTS

Figure 5:
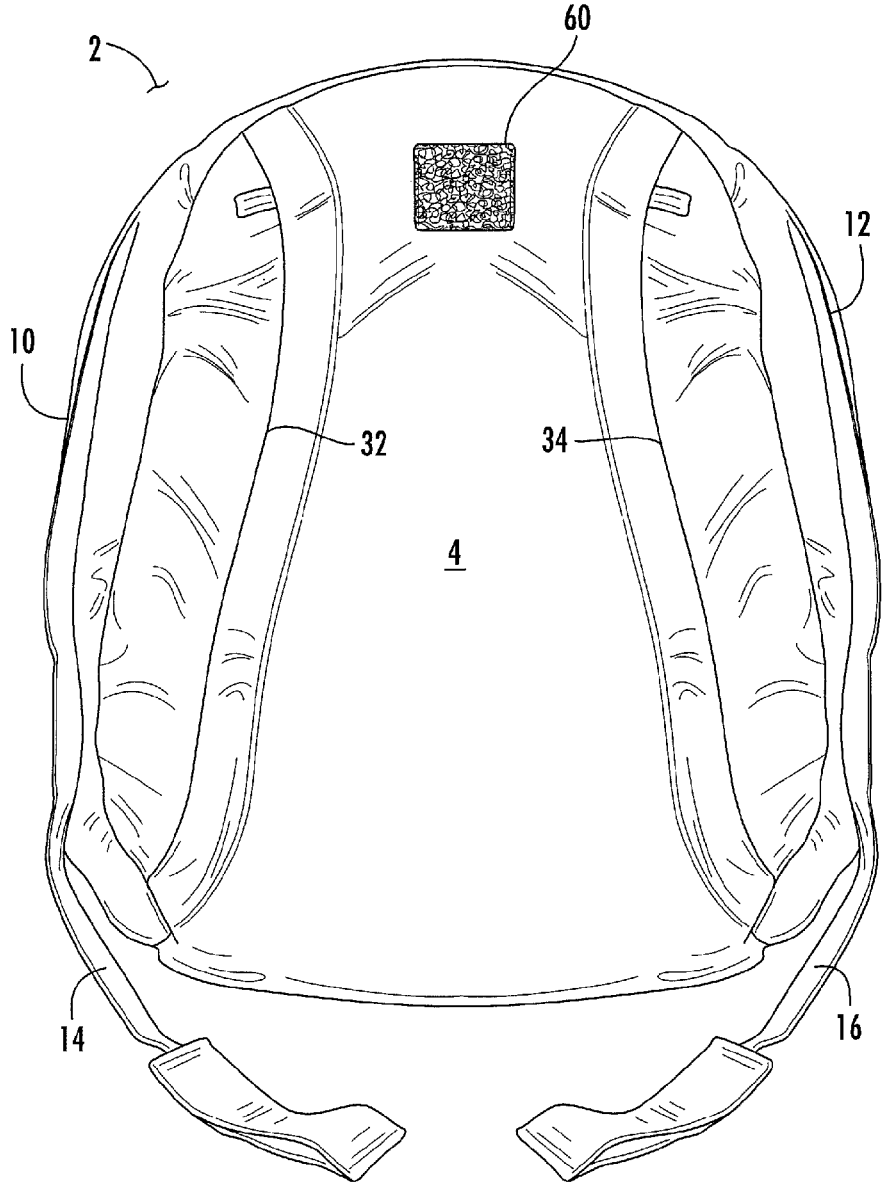
FIG. 5 is a rear perspective view of the pack prior to the body armor being deployed.
Figure 6:
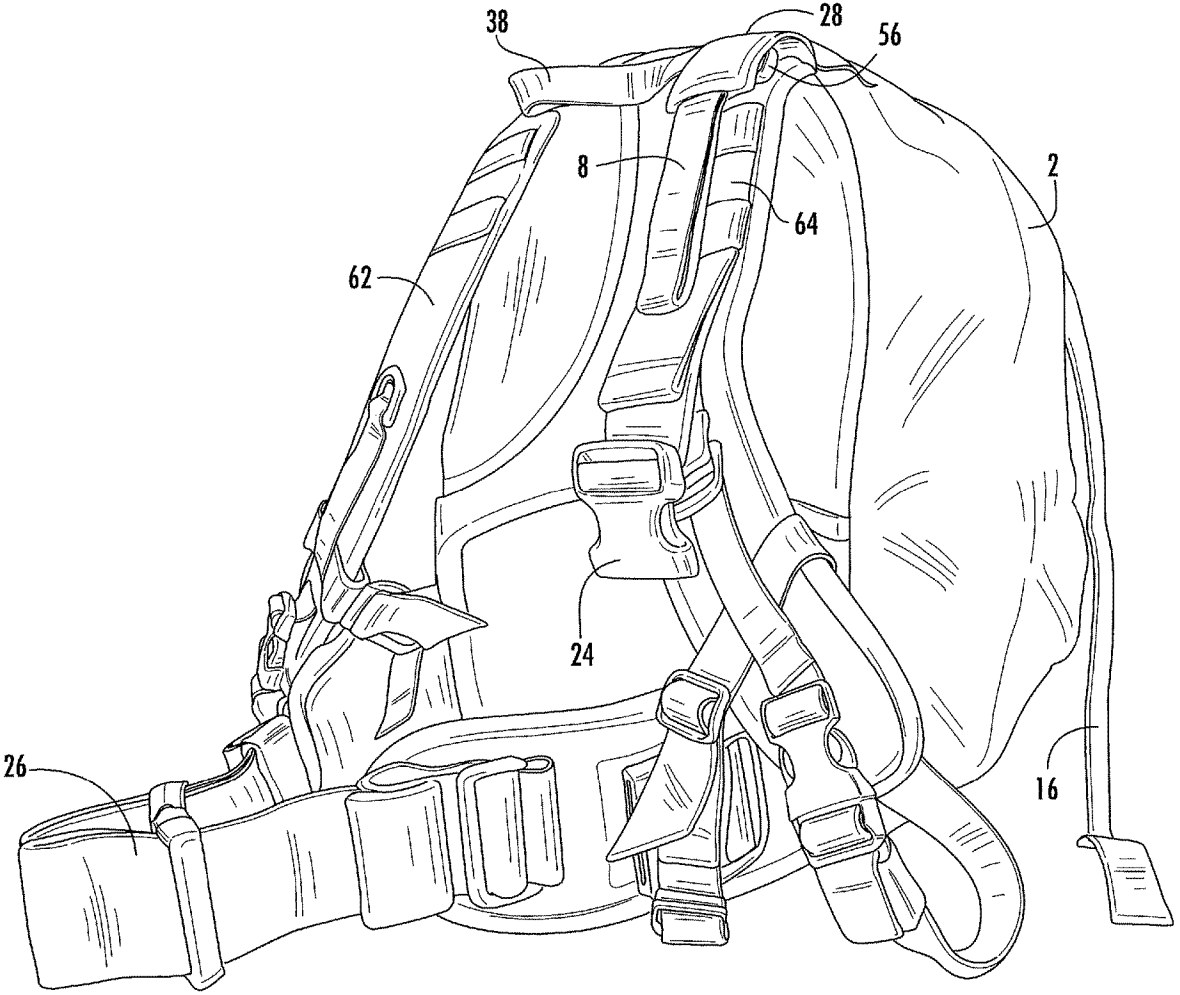
FIG. 6 shows a front view of the pack prior to the body armor being deployed.
Figure 7:
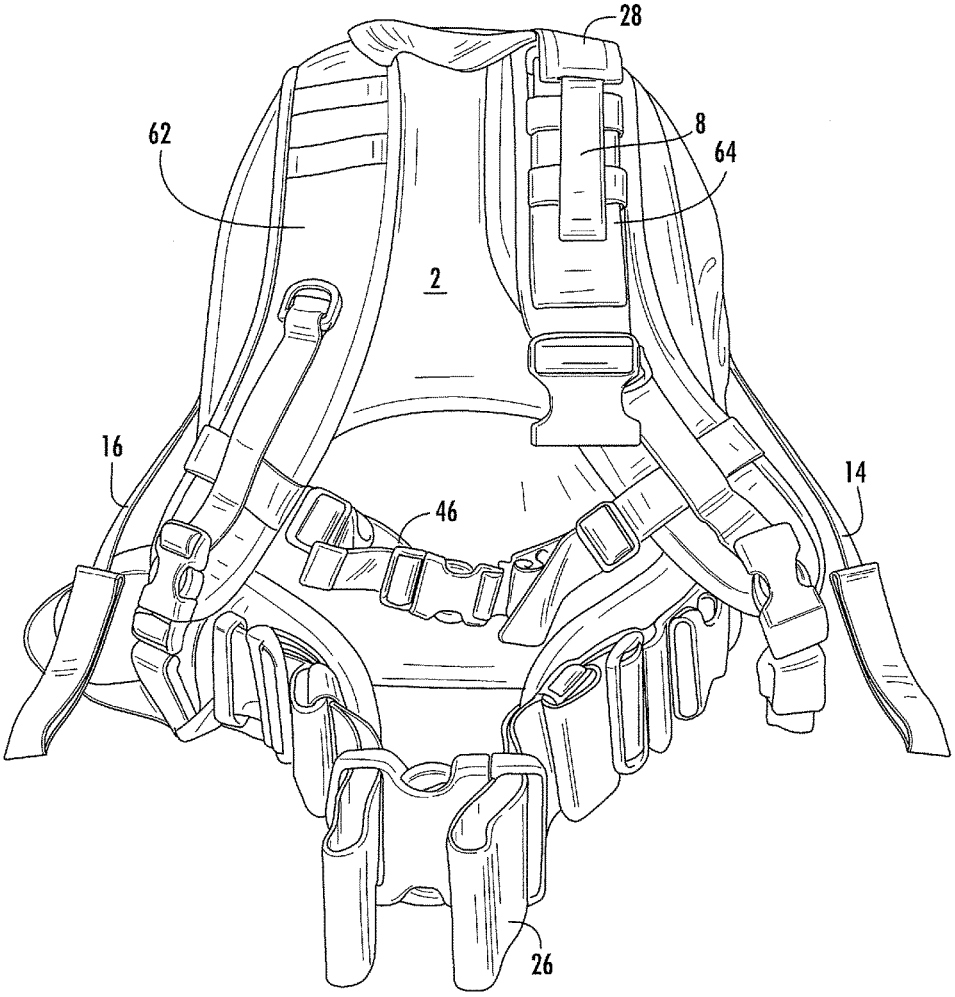
FIG. 7 shows the pack with the frontal body armor disconnected from the rear of the pack.

As shown in the configuration of FIG. 5 and FIG. 6, the pack 2 of the invention has an appearance that is similar to backpacks in common use. In the embodiment shown in those drawing figures, the front body armor panel 4 is held in place against the rear portion of the pack by a releasable connector. The connector first zipper 10 and a second zipper

12, with the zippers positioned on opposite sides of body armor panels 4,7. Attached to each zipper is an elongated pull, with the first pull 14 and second pull 16. The pulls 14,16 that are attached to the zipper are sufficiently long that when the zipper is engaged with the rear backpack along its entire length, the pulls hang below the bag as shown in FIG. 5, so that they may be grasped by the wearer and actuated by the wearer from the front. More particularly, when the backpack is being worn, the pulls are of sufficient length that a wearer can reach to the rear of the pack and grasp the first pull and the second pull and actuate the pulls by pulling in a downward motion to unzip and disconnect the front body armor panel from the rear of the pack without removing the pack from the wearer's back.

In another embodiment, the pulls 14, 16 are formed of an elastic material, like bungee cords. The pulls may be positioned over the shoulders of the wearer. The pulls are readily accessible for actuating the device as described herein. A panel 60 formed of hook and loop material may be positioned on the panel 4 which allows attachment of camouflage or a reflective material or other material that will disguise or distinguish the device when being worn with the appearance of a standard backpack.

Figure 1:
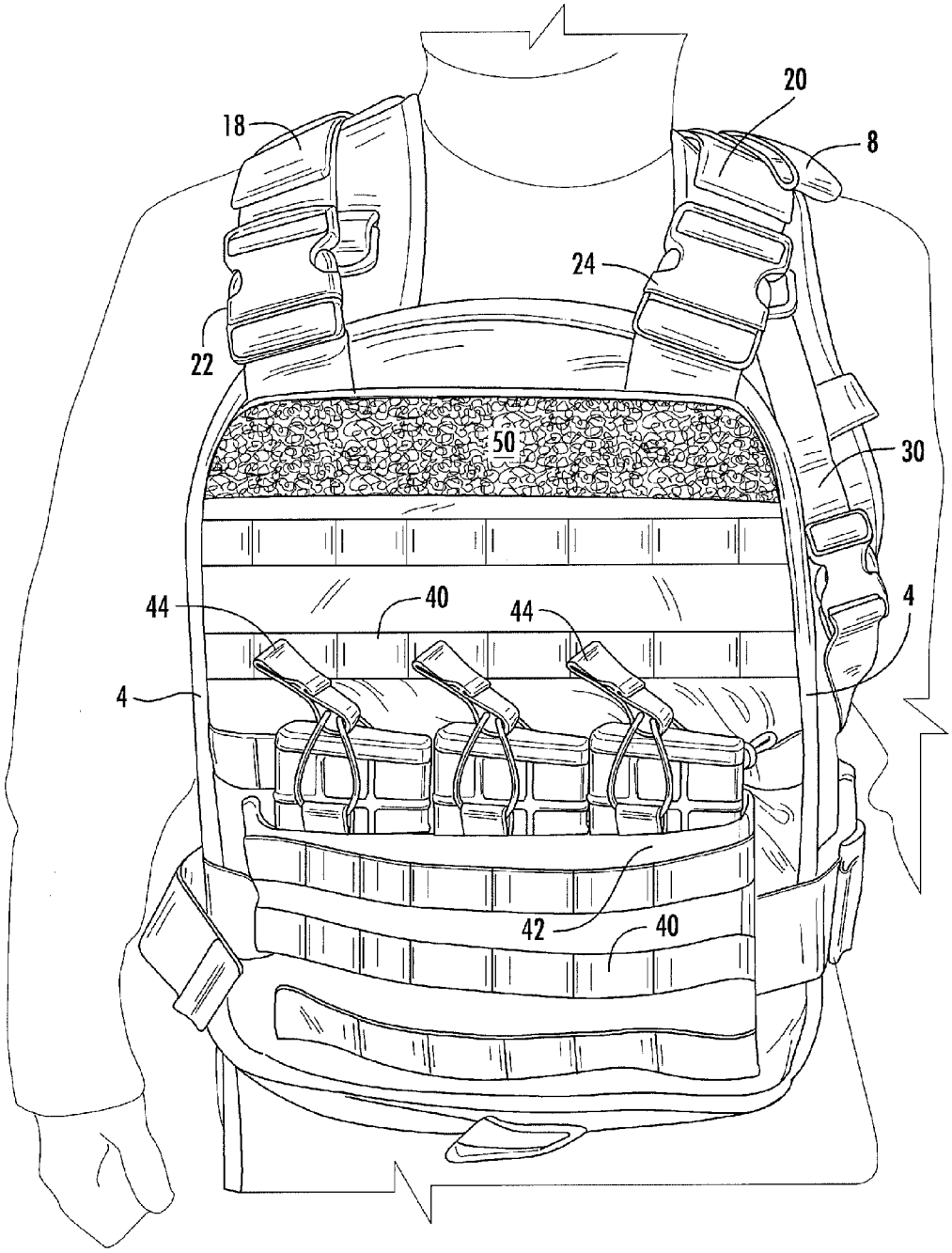
FIG. 1 shows a frontal view of the pack with body armor deployed.
Figure 3:
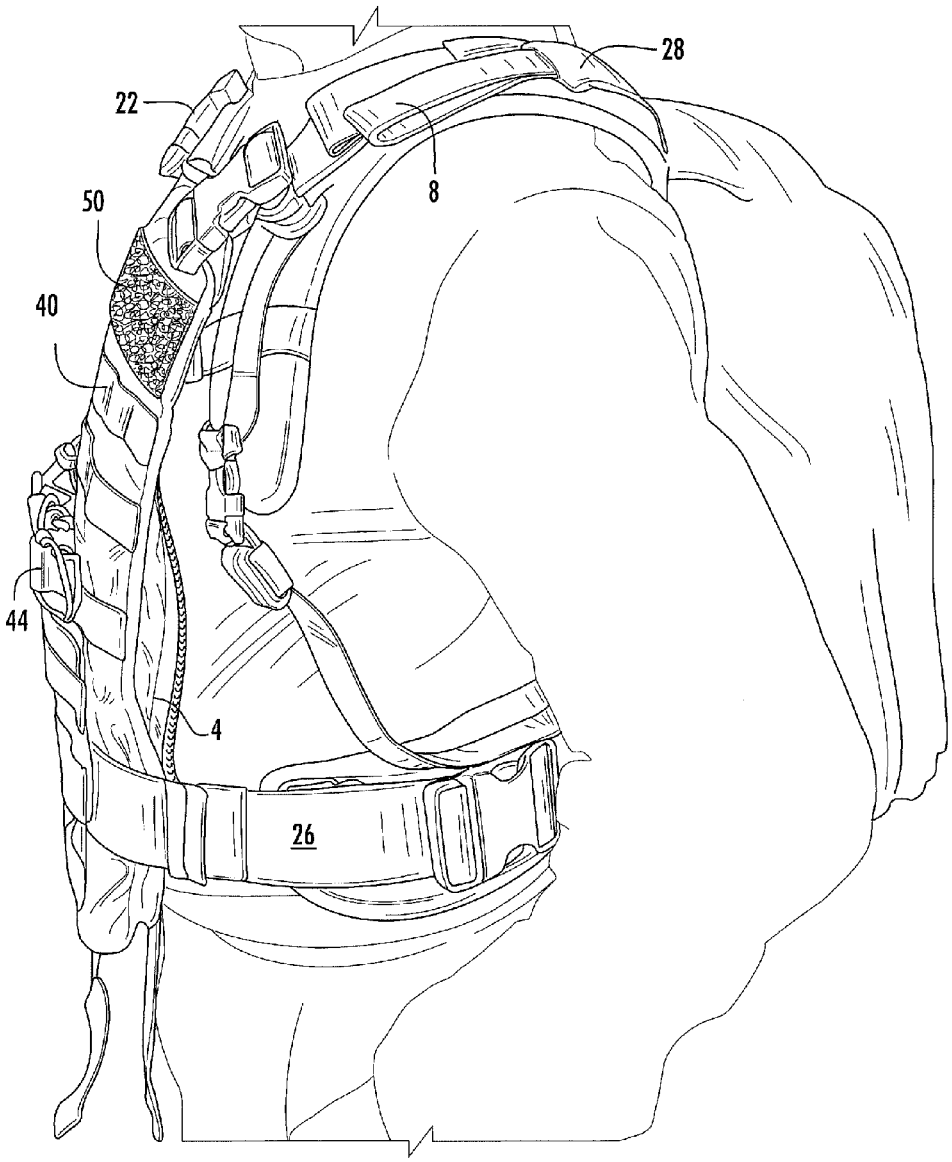
FIG. 3 shows a side view of the pack of FIG. 1 and FIG. 2.
Figure 4:
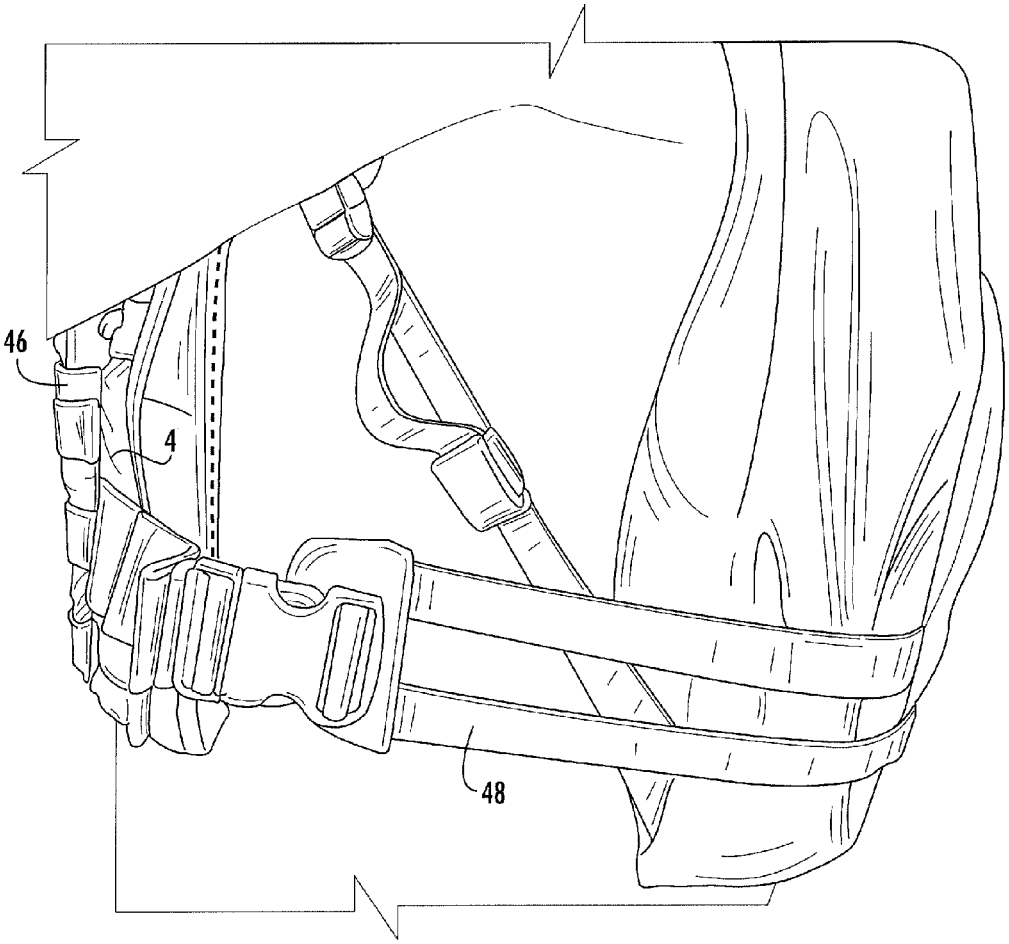
FIG. 4 shows a side view of the pack with body armor deployed to the front.
Figure 8:
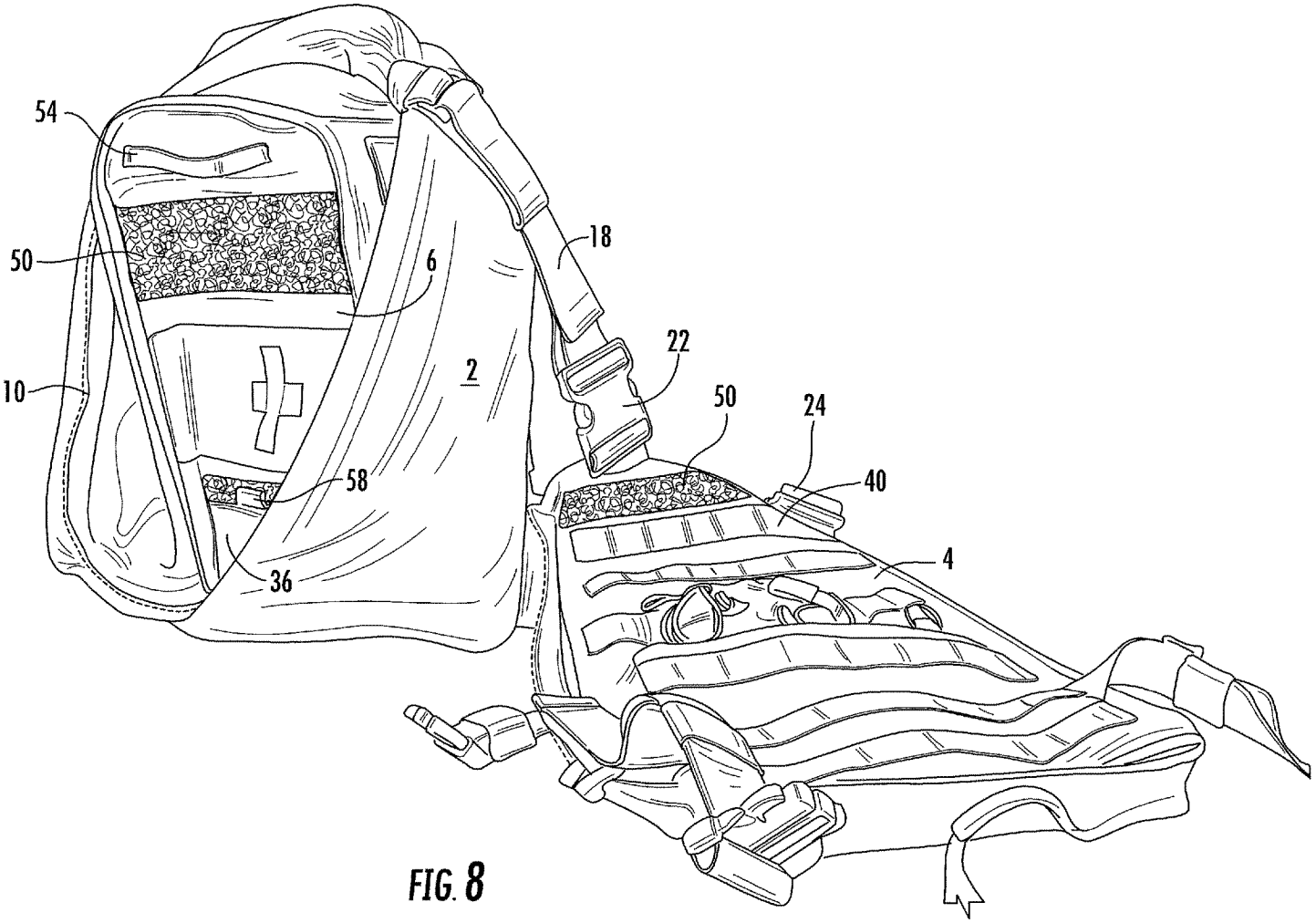
FIG. 8 shows the pack with the frontal body armor and contained bag detached from the pack.

After the body armor panel 4 is disconnected from the rear body armor panel 7, such as by unzipping the zippers 10,12, it is pivoted by the wearer to cover a front torso of the wearer as shown in FIG. 1. The front body armor panel is connected to the pack by a strap 18 that extends from the rear of the pack to the body armor panel. FIG. 8. This strap facilitates positioning of the body armor panel to the front of the pack while the pack is being worn and after the zippers 10, 12 are unzipped. This strap prevents the body armor panel from falling away from the pack so that it does not inadvertently drop on the ground. However, the strap, by being positioned near the top of the body armor panel facilitates positioning the body armor panel to the front of the wearer. Strap 18 also connects the pack to the front body armor panel while the body armor panel is in position for use as shown in FIG. 3 and FIG. 4.

Strap 18 has a releasable connector 22 and strap 20 has a releasable connector 24 as shown in FIG. 1. After the body armor panel 4 is in position in front of the wearer's torso, the strap 20 is connected to the body armor panel by connector 24. Strap 18 and strap 20 are contained inside the pack 2 until the front body armor panel is deployed. Connector 22 and connector 24 may be plastic snap in type connectors.

Alternatively, and according to user preference, strap 20, rather than strap 18, remains connected by connector 24 while inside the pack. The body armor is pivoted from the opposite side to cover the front of the wearer's torso. In that configuration, strap 18 and connector 22 are connected until the body armor panel is in position as shown in FIG. 1.

Pack 2 also provides a body armor panel that covers the rear torso of the wearer. The pack and the body armor panel 4 and body armor panel 7 provide body armor for the front and the back of the wearer when deployed as disclosed herein.

Layers of covering material may cover the body armor panels 4,7 associated with the pack 2. These layers may be formed of nylon or other textiles. In the case of woven materials or textiles, the pack and the body armor panels 4,7 may, in some cases, be formed of such materials without being positioned between layers of other materials, such as nylon.

The pack and panel may provide compartments that allow additional body armor plates to be inserted and removed at the user's discretion.

Body armor for forming the front and rear torso by the front body armor panel 4 and the rear body armor panel 7 may be formed of plastic resin composites, ceramics, oil and clay, and/or metals. The metals include woven metallic fibers, such as woven steel fibers. Other materials include woven Kevlar®, DSM's Dyneema, Honeywell's Gold Flex and Spectra, Teijin Twaron's Twaron, Pinnacle Armor's Dragon Skin, and Toyobo's Zylon. The front body armor panel 4 and the rear body armor panel 7 will, minimally, meet Ballistic Resistance of Body Armor NIJ Standard-0101.06.

Figure 9:
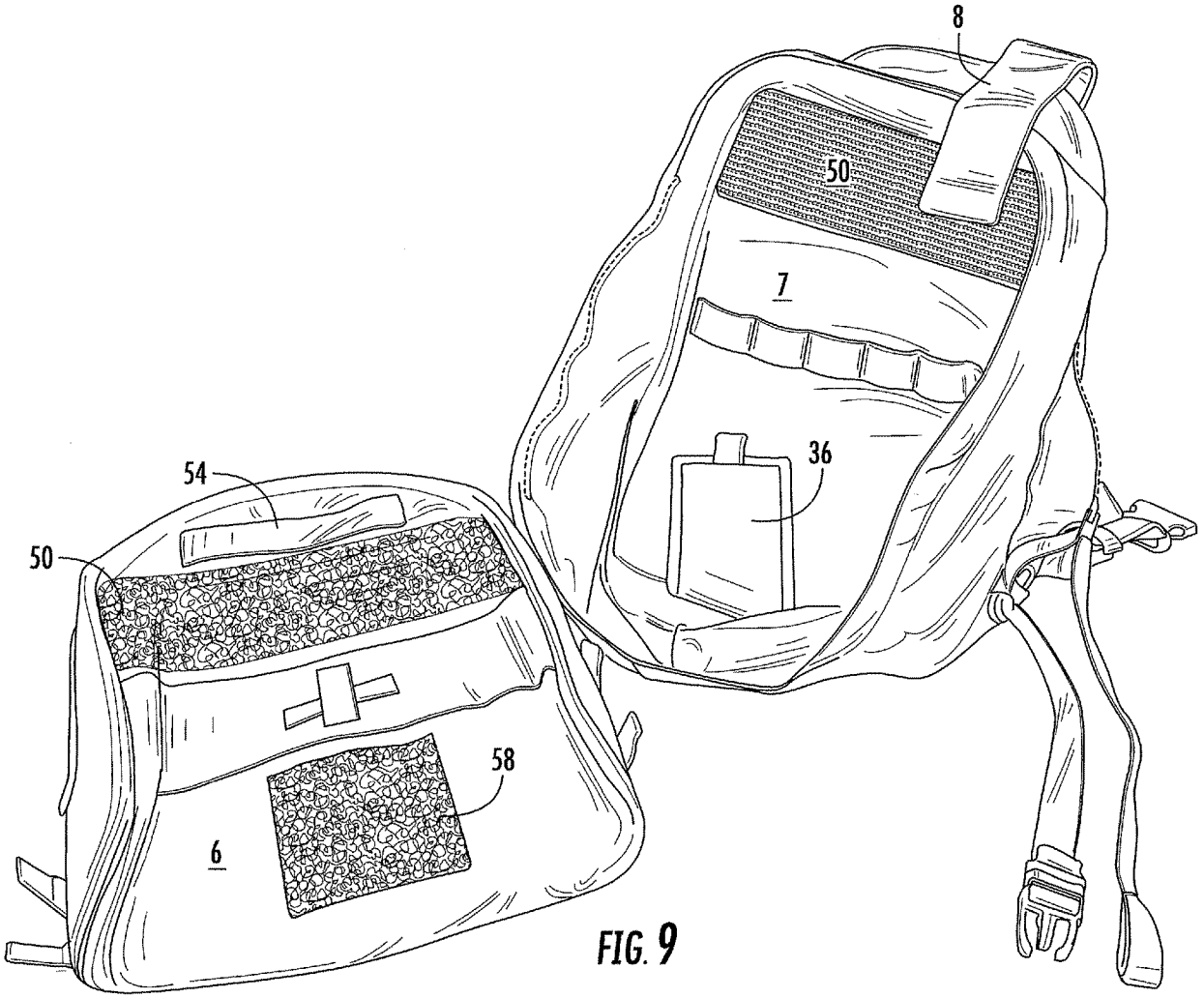
FIG. 9 shows the rear of the pack opened and an example of a detached bag.
Figure 10:
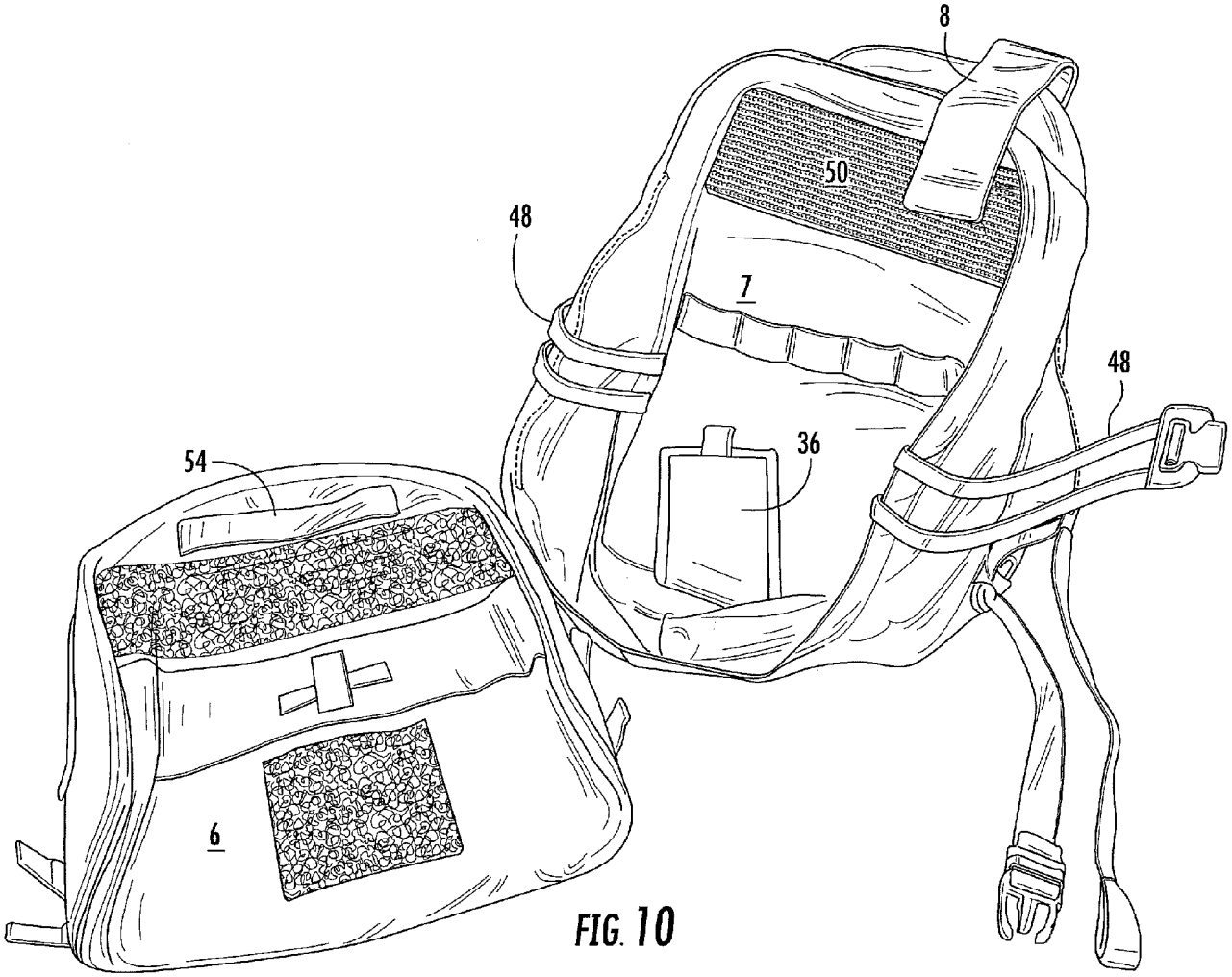
FIG. 10 shows another view of the rear of the pack opened and an example of a detached bag.
Figure 11:
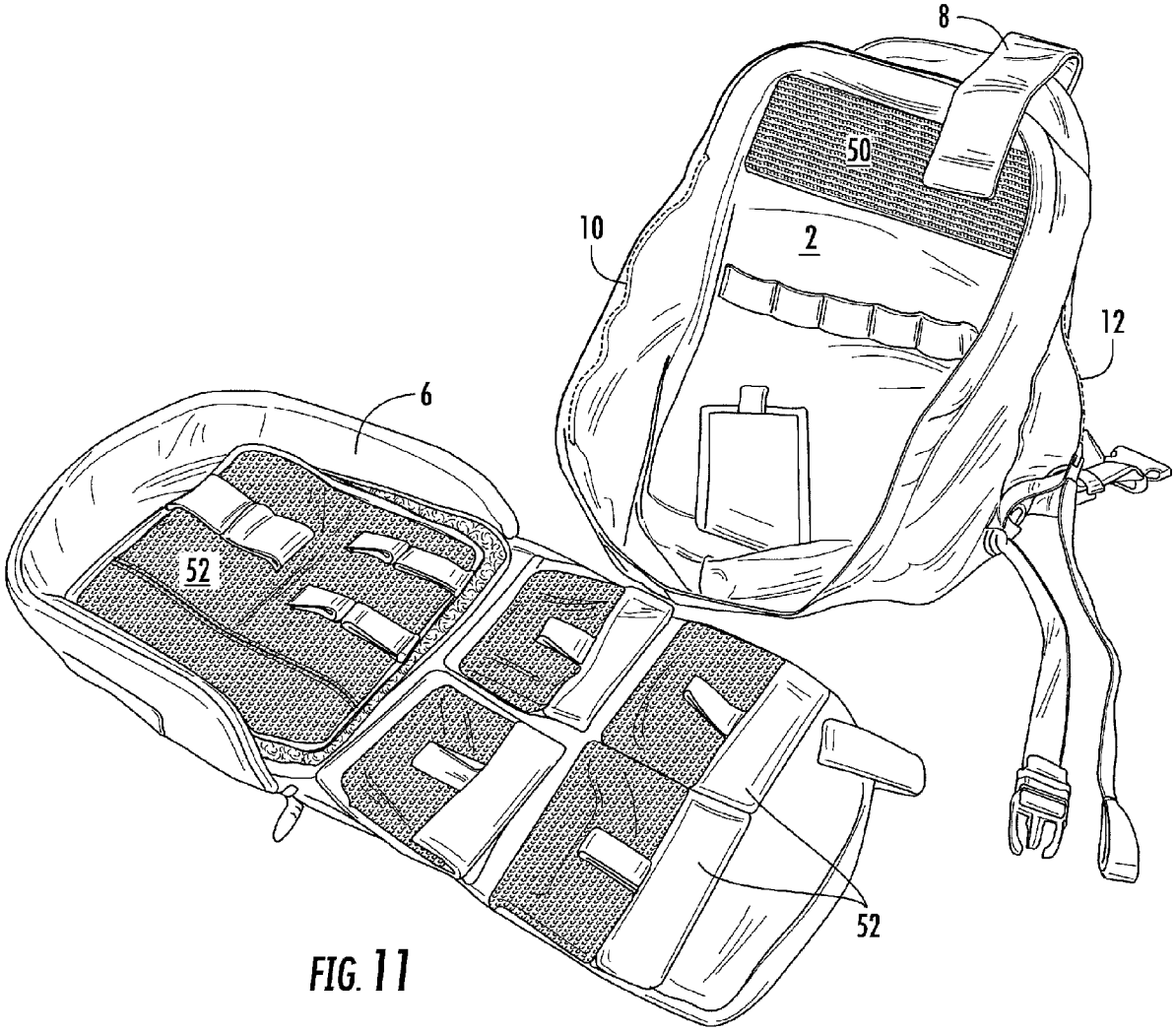
FIG. 11 shows another view of the rear of the pack opened and an example of an interior of a detached bag.

A bag 6 may be contained within the pack 2. FIG. 9. The bag may hold items as selected by the user. A series of compartments 52 with closures may be formed in the interior of the bag. FIG. 11. The bag may provide compartments 52 that are capable of selective separation from the bag. For example, the compartments may be held in place by hook and loop material or snaps, and separated. The compartments may be formed of mesh so that the contents are readily identifiable. A carry strap 54 for the bag may be provided.

In one embodiment, the bag is a trauma bag containing medical supplies. The bag and medical supplies may be quickly dropped according to a preferred embodiment of the invention. Medical supplies are useful for an injured or wounded person. The bag may be dropped from the rear of the pack without removing the pack or the body armor panel. However, the wearer of the bag, due to the urgency of the situation, may need to keep moving. The removable compartments allow further distribution of the bag's contents to multiple locations.

Figure 2:
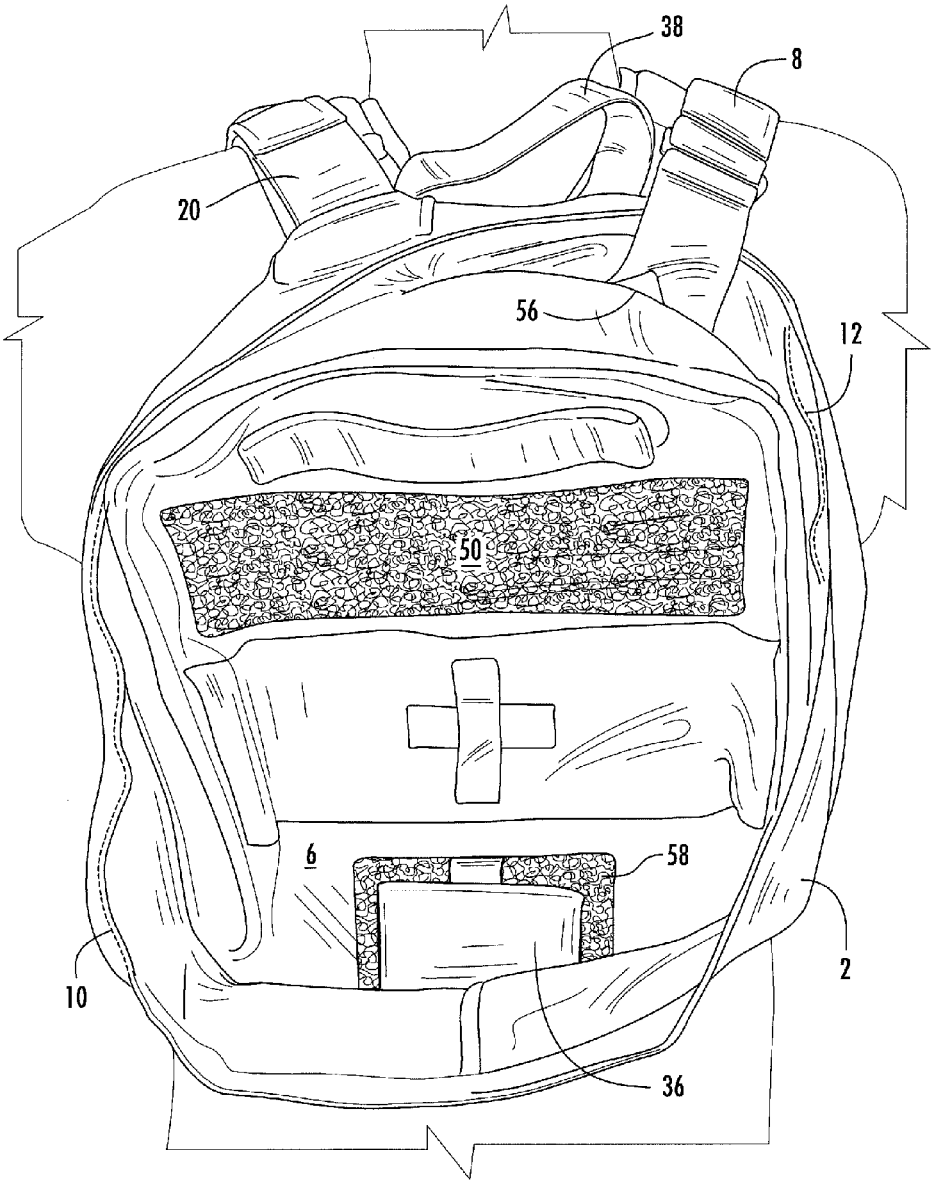
FIG. 2 shows a rear view of the pack of FIG. 1.

The bag 6 may be retained within the rear of the pack by strap 8 and hook and loop material formed on panel 36 and associated hook and loop material 58 formed on the bag. FIG. 2. However, the attachment of the bag by the lower connection formed by the hook and loop material 58 and the panel 36 may not be sufficiently strong to prevent the loaded bag from falling away by gravitational pull, but rather the hook and loop material of panel 36 secondarily holds the bag in place.

The bag is primarily held in place by a strap 8 that extends from the rear of the pack to the front of the pack, and over the shoulder of the wearer. An end of the strap 8 that extends to the rear of the pack has a connector to connect the strap 8 and the bag. The connector that connects the strap to the bag 6 may be hook and loop material, with the bag 6 having corresponding hook and loop material that connects to the end of the strap 8. The connection to the strap 8 primarily prevents the bag from falling out of the pack when the pack is worn as shown in FIG. 1 and FIG. 2, and the bag is secondarily held in place by the lower hook and loop connection of the bag and panel 36.

When the end of the strap 8 that extends to the front side of the pack is sharply pulled by the wearer, the hook and loop connection between the strap and the bag is disconnected. The bag 6, due to weight and gravitational pull, falls away and below the pack and may disconnect from the pack at the lower hook and loop connection if the weight of the bag is sufficient to disconnect the lower hook and loop connection. If the bag does not disconnect from the pack, the wearer can reach to the rear of the bag that is hanging from panel 36, and pull the bag to disconnect the lower hook and loop connection of the panel and the bag.

A guide loop 28 may be formed in the pack through which the strap slideably traverses, and which prevents the strap from falling away from the pack as the strap is disconnected from the bag. Hook and loop material is preferred to be provided to retain connection 56 of the strap to the bag. The degree of connection of the bag to the pack may be adjusted according to the weight of the pack.

As shown in FIG. 5, the body armor panel 4 may have pockets. As shown, the body armor panel has a first zippered pocket 32 and a second zippered pocket 34. An internal divider may separate the pockets. One or both pockets may have hook or loop material inside the pocket for attachment of, for example, a weapon holster. When the body armor panel 4 is in the position shown in FIG. 1, the weapon is easily accessible.

Shoulder straps 62,64 are provided for wearing the pack 2 as one would wear a standard backpack. FIG. 6. The pack 2 may have a carry handle 38.

Modular lightweight load-carrying equipment (MOLLE) attachments 40 may be provided on the body armor panel 4 or in other places, such as MOLLE attachments 41 inside the pack. FIG. 1; FIG. 9. Pockets 42 for ammunition magazines may be provided, with quick detachment retainers 44.

FIG. 4 shows a side view of the pack 2 with the body armor panel 4 in position and covering a front of the wearer's torso. Devices that assist in retaining the pack on the wearer may include chest strap that fastens over the chest of the user. In a preferred embodiment, alternate devices are provided to retain the devices about the waist. As shown in FIG. 6, a battle belt 26 may be provided. Alternatively, a cummerbund 48 is provided having removable straps that are made from MOLLE. FIG. 4. The battle belt or the cummerbund as selected connects by a connector at the front of the torso of the wearer to surround the wearer's waist. If the cummerbund is not used, front panel straps connect to the hip or battle belt.

Hook and loop material 50 may be provided on the pack 2 to attach signs having indicia such as police, fire, EMS, etc., or for attaching reflective material or the like.

What is claimed:

1. A wearable pack comprising:

in a first configuration, a) a rear body armor panel;

b) a front body armor panel facing and connected to the rear body armor panel by a releasable connector, the releasable connector having a release actuator that extends to a side of the rear body armor panel that is opposite the front body armor panel;

c) a shoulder strap in communication with the rear body armor panel;

d) a bag, wherein the bag is positioned in a space formed between the front body armor panel and the rear body armor panel; and e) a connecting strap extending from an exterior of the rear body armor panel to the space formed between the front body armor panel and the rear body armor panel, wherein the connecting strap is connected to the bag by a releasable connector, and the releasable connector is constructed and arranged to disconnect from the bag upon application of a force to a portion of the connecting strap that extends to the exterior of the rear body armor panel;

and in a second configuration, the releasable connector is released, and front body armor panel is constructed and arranged for positioning over a front of a torso of a user, while the rear body armor panel is constructed and arranged to cover a back of a torso of a user, wherein a side of the front body armor facing the rear body panel in the first configuration is facing outwardly in the second configuration.

2. A wearable pack as described in claim 1, further comprising a first strap that connects the front body armor panel to the rear body armor panel near an upper portion of the front body armor panel and an upper portion of the rear body armor panel, and a second strap that is connected to the front body armor panel and to the rear body armor panel near the upper portion of the front body armor panel and an upper portion of the rear body armor panel, and having a releasable connector, wherein in the first configuration, the first strap and the second strap are positioned between the front body armor panel and the rear body armor panel and in a space formed between the front body armor panel, and the rear body armor panel, and the releasable connector is not connected, so that the front body armor panel is not connected to the rear body armor panel by means of the second strap.

3. A wearable pack as described in claim 1, wherein, in the second configuration, the bag is positioned against the rear body armor panel and is held in place against the rear body armor panel by the connecting strap.

4. A wearable pack as described in claim 1, further comprising a second releasable connector joining the bag to the rear body armor panel.

5. A wearable pack as described in claim 1, further comprising a second releasable connector joining the bag to the rear body armor panel, wherein, in the second configuration, the second releasable connector is insufficient to hold the bag against the rear body armor panel when the connecting strap is disconnected from the bag.

6. A wearable pack as described in claim 1, further comprising a guide loop in which a portion of the strap is positioned, wherein the guide loop is positioned to guide the strap into the rear body armor panel.

7. A wearable pack as described in claim 2, wherein in the second configuration, the releasable connector is connected, so that the front body armor panel is connected to the rear body armor panel by means of the second strap.

8. A wearable pack as described in claim 1, further comprising a first strap that connects the front body armor panel to the rear body armor panel near an upper portion of the front body armor panel and an upper portion of the rear body armor panel, and a second strap that is connected to the front body armor panel and to the rear body armor panel near the upper portion of the front body armor panel and an upper portion of the rear body armor panel, and having a releasable connector, wherein in the first configuration, the first strap and the second strap are positioned between the front body armor panel and the rear body armor panel and in a space formed between the front body armor panel, and the rear body armor panel, and the releasable connector is not connected, so that the front body armor panel is not connected to the rear body armor panel by means of the second strap.

9. A wearable pack as described in claim 8, wherein in the second configuration, the releasable connector is connected, so that the front body armor panel is connected to the rear body armor panel by means of the second strap.

10. A wearable pack as described in claim 1, further comprising a connector material that is connectable to hook material or loop material, wherein the connector material is present on a front of the front body armor panel in the second configuration.

11. A wearable pack as described in claim 1, further comprising a connector material that is connectable to hook material or loop material, wherein the connector material is present on a rear of the rear body armor panel in the second configuration.

12. A wearable pack as described in claim 1, further comprising a flap on the rear body armor portion, the flap comprising a second releasable connector joining the bag to the rear body armor panel.

13. A wearable pack as described in claim 1, wherein the connecting strap is connected to the bag by hook and loop material.

14. A wearable pack as described in claim 1, wherein, in the first configuration, the front body armor panel facing is connected to the rear body armor panel by a zipper.

15. A wearable pack as described in claim 1, the front body armor panel comprises modular lightweight load-carrying equipment attachments.

* * * * *